US010604986B2

(12) United States Patent
Folk

(10) Patent No.: US 10,604,986 B2
(45) Date of Patent: Mar. 31, 2020

(54) AMMUNITION SAFE

(71) Applicant: James Carl Folk, Naples, FL (US)

(72) Inventor: James Carl Folk, Naples, FL (US)

( * ) Notice: Subject to any disclaimer, the term of this patent is extended or adjusted under 35 U.S.C. 154(b) by 4 days.

(21) Appl. No.: 15/996,874

(22) Filed: Jun. 4, 2018

(65) Prior Publication Data

US 2019/0055771 A1 Feb. 21, 2019

Related U.S. Application Data

(60) Provisional application No. 62/546,873, filed on Aug. 17, 2017.

(51) Int. Cl.
*E05G 1/024* (2006.01)
*E05G 1/12* (2006.01)

(52) U.S. Cl.
CPC ..... *E05G 1/024* (2013.01); *E05G 1/12* (2013.01)

(58) Field of Classification Search
CPC .. E05G 1/00; E05G 1/02; E05G 1/024; E05G 1/12
See application file for complete search history.

(56) References Cited

U.S. PATENT DOCUMENTS 3,757,933 A 9/1973 Banta
4,048,926 A * 9/1977 Brush, Jr. ..... E05G 1/024 109/65
5,052,569 A * 10/1991 Cooper ..... B65D 90/023 220/1.5
5,390,580 A * 2/1995 Gibbons, Jr. ..... F41H 5/0457 109/49.5
6,736,473 B2 * 5/2004 Cleveland ..... E05G 1/024 109/80
6,752,085 B2 6/2004 Roach
6,976,340 B2 * 12/2005 Schulze ..... B01L 1/02 414/217
7,252,586 B2 * 8/2007 Schulze ..... B01L 1/02 454/187
7,399,719 B2 * 7/2008 Hanan ..... E05G 1/024 442/136
7,624,888 B1 12/2009 Pudlak et al.
(Continued)

FOREIGN PATENT DOCUMENTS

DE 2209111 8/1973
FR 449191 A 2/1913
(Continued)

*Primary Examiner* — Christopher J Boswell
(74) *Attorney, Agent, or Firm* — Michael Best & Friedrich LLP

(57) ABSTRACT

A safe for storing ammunition or other heat-sensitive explosive materials. The safe includes a plurality of walls, a door attached to one of the plurality of walls, an interior space defined by the plurality of walls and the door, an opening extending through one of the plurality of walls or the door, a pane coupled over the opening, and a cover coupled to the one of the plurality of walls or the door adjacent the pane. The pane automatically exposes the opening when the interior space reaches a predetermined temperature, which is lower than the temperature at which ammunition or other heat-sensitive explosive material detonates. Accordingly, the safe provides for pressure release before the ammunition or other heat-sensitive explosive material detonates.

20 Claims, 5 Drawing Sheets

(56) References Cited

U.S. PATENT DOCUMENTS

| | | | | |
|---|---|---|---|---|
| 8,578,866 | B2 * | 11/2013 | Luling | E05G 1/005 109/49.5 |
| 8,997,774 | B2 | 4/2015 | Kotefski et al. | |
| 2014/0061515 | A1 | 3/2014 | Traxler et al. | |

FOREIGN PATENT DOCUMENTS

| | | | |
|---|---|---|---|
| GB | 2514798 | B | 8/2016 |
| WO | 2014106566 | A1 | 7/2014 |

* cited by examiner

AMMUNITION SAFE

This application claims priority to U.S. Provisional Application No. 62/546,873, filed Aug. 17, 2017, the entire contents of which is hereby incorporated by reference.

BACKGROUND

The present invention relates to a safe or storage container for ammunition or other heat-sensitive explosive materials that may be detonated or cause damage due to excessive heat. The present invention provides for pressure release before the ammunition or other heat-sensitive explosive material detonates.

SUMMARY

In one embodiment, the invention provides a safe for storing ammunition or other heat-sensitive explosive materials. The safe includes a plurality of walls, a door attached to one of the plurality of walls, an interior space defined by the plurality of walls and the door, an opening extending through one of the plurality of walls or the door, a pane coupled over the opening, and a cover coupled to the one of the plurality of walls or the door adjacent the pane. The pane automatically exposes the opening when the interior or exterior space reaches a predetermined temperature.

In another embodiment the invention provides a safe configured to receive ammunition or other heat-sensitive explosive materials. The safe includes a plurality of walls forming the sides, bottom, and top of the safe and an outer wall coupled to and substantially parallel to one of the plurality of walls. A door is attached to one of the plurality of walls and an interior space is defined by the plurality of walls and the door. An opening extends through one of the plurality of walls or the door. A pane is coupled over the opening to one of the plurality of walls or the door with a material that melts at a predetermined temperature, and the pane automatically uncouples from one of the plurality of walls or the door at a predetermined temperature.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The safe storage of ammunition in a home, an office and another unsecure location has been and continues to be, a subject of much debate and research. Of great concern is the behavior of ammunition in the event of a structural fire, which causes extreme temperatures (e.g. approximately 1100 degrees F.) that could detonate the unspent ammunition.

Ammunition is conventionally stored in many ways. For example, ammunition may be loose, kept in the original manufacturer's cardboard boxes, or in a plastic container. Also, many gun owners use "military" ammunition metal boxes for storage of their ammunition. Many gun owners store extra ammunition in and along with their guns in traditional gun safes. Others place their ammunition in garages or other remote buildings and place the ammunition in remote areas in the structure (e.g., in holes in basement floors).

Regardless of how ammunition is stored, it must be kept secure, clean and dry, and in reasonably close proximity to its use or need on a daily basis. This moisture-free requirement causes users to seal the ammunition in an array of different containers, many of which are metal. However, sealing ammunition in a metal container can create a "bomb" in the event that the interior temperature rises to the point that the ammunition detonates. Ammunition is dangerous when stored in sealed metal containers, including many of the commercially available advertised "air tight" safes and vaults. Even the advertised "fire proof" safes and vaults should not be considered safe when storing ammunition, in the event of a fire.

FIGS. 1*a*, 1*b*, 2*a*, 2*b*, 2*c*, 2*d*, and 2*e* illustrate various embodiments of the invention, each including a container or safe 10 for storing ammunition or other heat-sensitive explosive materials that may be detonated or cause damage due to excessive heat. For the purposes of this patent, "safe" may mean a safe, can, enclosure, case, cabinets, lock box, or other device that is designed to be or can be used to store ammunition and that is designed to unlock or lock by means of a key, combination or other similar means. Safes are generally metal but may be constructed from any suitable material (e.g., ceramic).

Figure 1A:
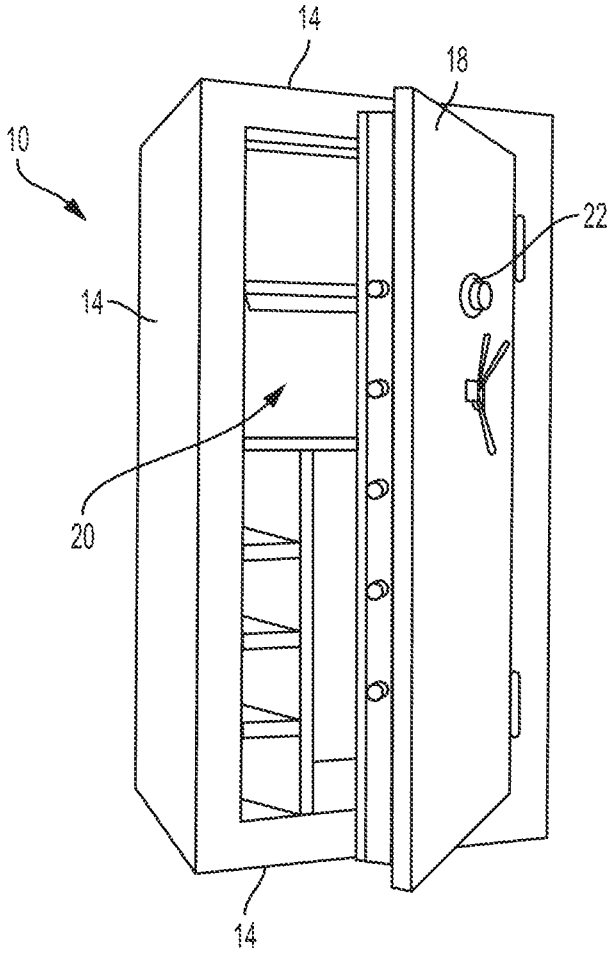
FIG. 1*a* is a perspective view of a floor-style insulated safe.
Figure 1B:
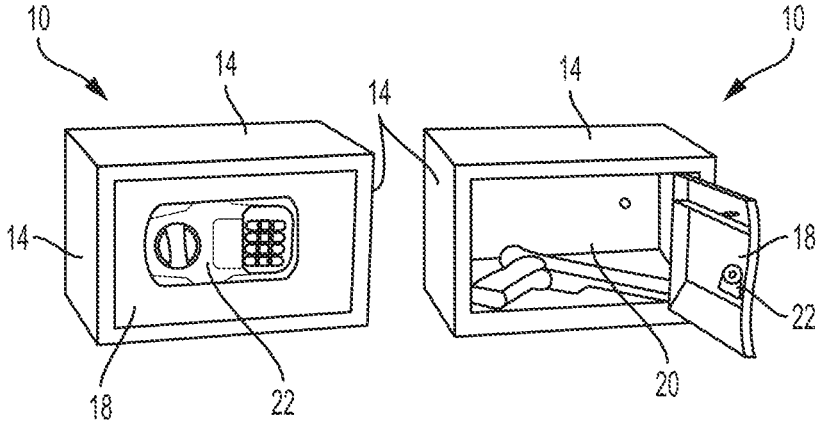
FIG. 1*b* is another perspective view of a wall- or table-style safe.

The safe includes a plurality of walls 14 which form the sides, top, and bottom of the safe and a door 18 hingedly attached to one of the plurality of walls 14. The walls 14 and door 18 define an interior space 20 of the safe 10 that receives ammunition or other heat-sensitive explosive materials. The door includes a locking mechanism 22 (i.e., a rotary combination, a keypad, or any suitable locking mechanism). For purposes of this invention, the floor-style safe of FIG. 1*a* and the wall- or table-style safe of FIG. 1*b* are functionally the same.

Figure 2A:
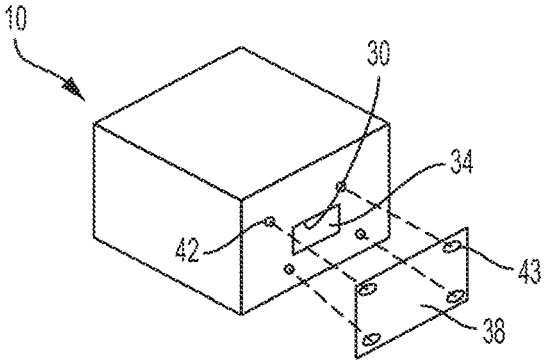
FIG. 2*a* is a partially exploded schematic view of a portion of the safe of FIG. 1*a* or 1*b* including an opening according to one embodiment of the invention.
Figure 2B:
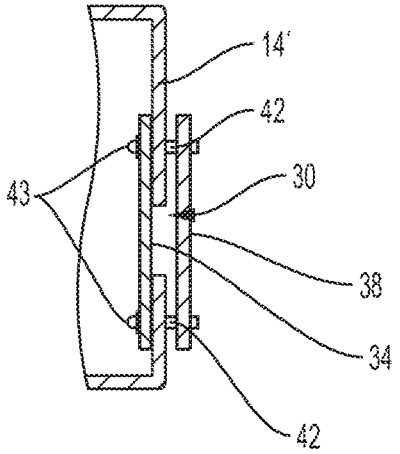
FIG. 2*b* a cross sectional schematic view of the portion of the safe of FIG. 2*a*.
Figure 2C:
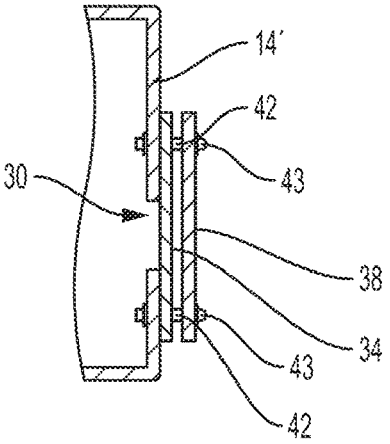
FIG. 2*c* a cross-sectional schematic view of a portion of the safe of FIG. 1*a* or 1*b* including an opening according to a second embodiment of the invention.
Figure 2D:
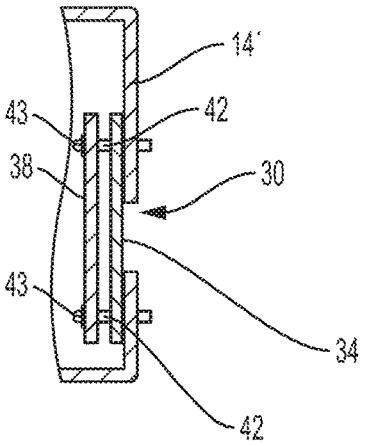
FIG. 2*d* a cross-sectional schematic view of a portion of the safe of FIG. 1*a* or 1*b* including an opening according to a third embodiment of the invention.
Figure 2E:
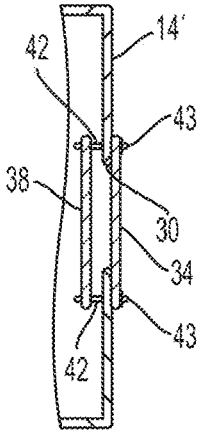
FIG. 2*e* a cross-sectional schematic view of a portion of the safe of FIG. 1*a* or 1*b* including an opening according to a fourth embodiment of the invention.

One of the plurality of walls 14' includes an opening 30 extending therethrough to the interior space 20 in the embodiment of FIGS. 1*a*, 1*b*, 2*a*, 2*b*, and 2*c*. In other embodiments, the opening 30 may extend through the door 18. The size of opening 30 is calculated based upon the interior cubic feet of the safe to insure the timely release of internal pressure. A pane 34 is coupled to wall 14' over the opening 30, either within the interior space 20 (as in FIGS. 2*b* and 2*d*) or exterior to the wall 14' (as in FIGS. 2*c* and 2*e*). The pane 34 may be mechanically held in place by any form of attachment (e.g., by fasteners). In FIGS. 2*b*,2*c*, 2*d*, and 2*e*, the pane 34 seals against the wall 14'. The seal may be made via any suitable sealant or adhesive such as a high temperature silicone gel. A plate or cover 38 is coupled to a surface of the wall 14' adjacent the pane 34 via fasteners 43 (i.e., by at least one screw/washer and nut assembly or the like). The embodiments of FIGS. 2*b* and 2*c* illustrate that the cover 38 is coupled to an exterior surface of the wall 14' (i.e., by fasteners 43). In the embodiments of FIGS. 2*d* and 2*e*, the cover 38 is coupled to an interior surface of the wall 14'. As shown in the embodiments of FIGS. 2*b*-2*e*, the cover 38 is spaced apart from the wall 14' (i.e., either the exterior or interior surface of the wall 14') by spacers 42. There is also an air gap between cover 38 and pane 34 leading to the exterior. The pane 34 and the cover are preferably larger than the opening 30 (i.e., larger in length and width). Additionally, although not illustrated in all of FIGS. 2*b*-2*e*, preferably, the pane 34 and the cover 38 have the substantially the same dimensions.

Further with respect to FIGS. 2*a*, 2*b* and 2*c*, the pane 34 provides a barrier to dust and dirt intrusion and a barrier to moisture intrusion. Additionally and importantly, the pane 34 automatically separates from the wall 14' at a predetermined temperature (i.e., a temperature lower than that at which ammunition detonates). In the embodiment of FIGS. 2*a*-2*c*, the pane 34 is constructed from a material that has a lower melting point (i.e., the predetermined temperature) than the temperature at which ammunition detonates (i.e., self-detonation of 22 long rifle bullet is at 275 degrees F., 38 special bullet is at 290 degrees F., and 12 gauge shotgun shell is at 387 degrees F.) The pane 34 material may be low density polyethylene (LDPE), for example, although any suitable material is within the scope of the invention. The fasteners 43 and spacers 42 are constructed of a material that has a melting point above the predetermined temperature, such as machine tool steel bolts, washers and nuts. In the event of a fire, the pane 34 melts or otherwise separates from the wall 14' before the temperature within the safe 10 reaches that at which ammunition contained within will detonate so that opening 30 is exposed. The cover 38 is oriented relative and sufficiently close to, but spaced apart from, the opening 30 so that if the ammunition detonates, the cover 38 blocks and prevents debris and fragments from exiting the safe 10 through the opening 30, while also restricting access to the interior space 20. The fire-increased internal pressure of the safe 10 is released through the now-exposed opening 30, but the dangerous ammunition fragments are retained within the safe 10.

Figure 3A:
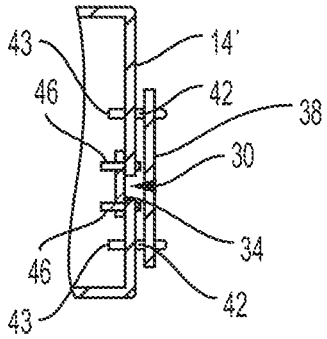
FIG. 3*a* a cross-sectional schematic view of a portion of the safe of FIG. 1*a* or 1*b* including an opening according to a fifth embodiment of the invention.
Figure 3B:
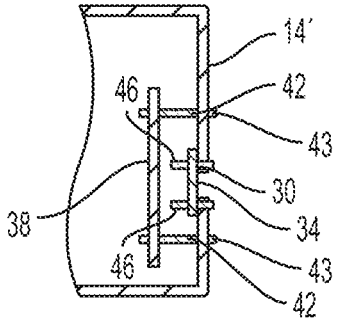
FIG. 3*b* a cross-sectional schematic view of a portion of the safe of FIG. 1*a* or 1*b* including an opening according to a six embodiment of the invention.

In embodiments shown in FIGS. 3*a* and 3*b*, respectively, the pane 34 may be constructed of any suitable material (not necessarily material having a lower melting point than the temperature at which ammunition will detonate) and coupled to the wall 14' by fasteners 46 (e.g., screw, nuts, bolts and the like) that have a specified melting temperature lower than the ammunition detonation temperature (i.e., the predetermined temperature). The fasteners 46 may be constructed of a plastic material such as polyetheretherketone (PEEK), although fasteners 46 may be constructed of any material with a suitable melting temperature lower than the ammunition detonation temperature. Accordingly, when the temperature within the safe 10 rises to the melting point of the fasteners 46, the fasteners 46 will melt and allow the pane 34 to fall away from the side of the safe, allowing internal high pressure heated air to escape through the opening 30. Again, cover 38 blocks and prevents the escape of debris and fragments from the opening 30.

Figure 4:
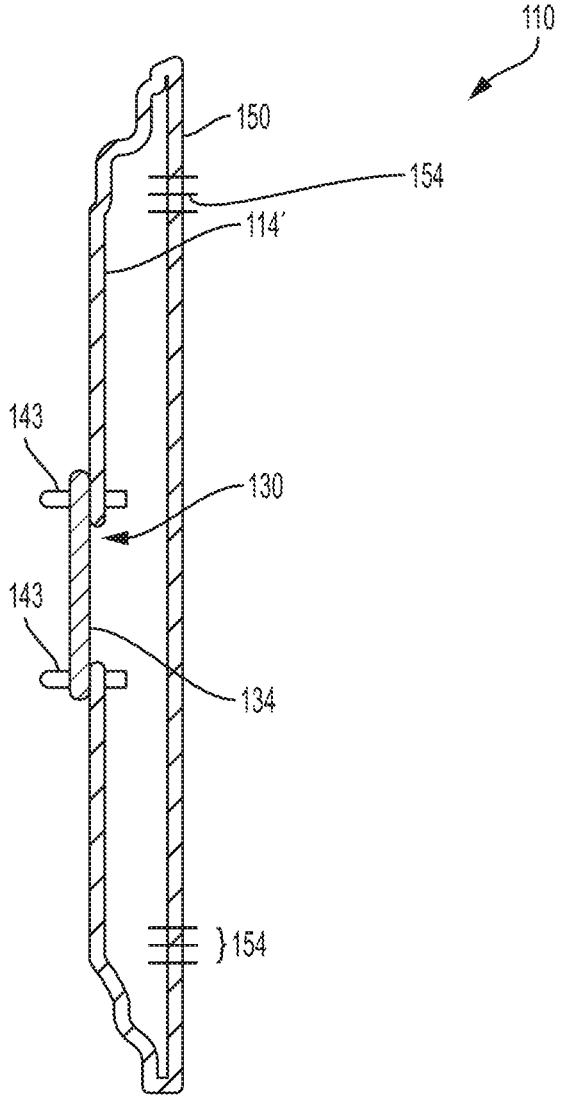
FIG. 4 is a cross-sectional schematic view of a portion of the safe of FIG. 1*a* or 1*b* including an opening according to a seventh embodiment of the invention.
Figure 5:
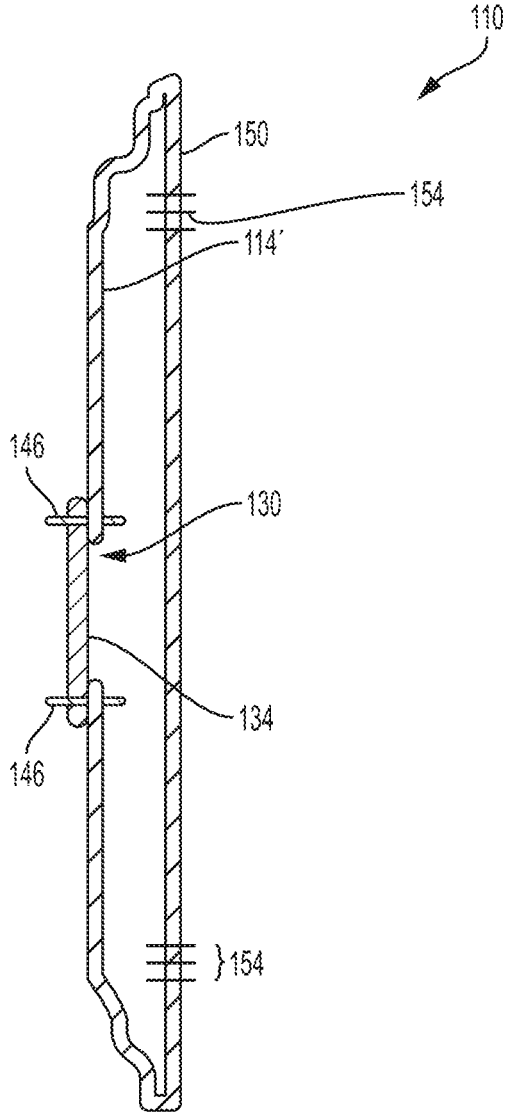
FIG. 5 is a cross-sectional schematic view of a portion of the safe of FIG. 1*a* or 1*b* including an opening according to a eighth embodiment of the invention.

FIGS. 4 and 5 illustrate additional embodiments of the invention including a container or safe 110 for storing ammunition or other heat-sensitive explosive materials that may be detonated or cause damage due to excessive heat. The safes 110 of FIGS. 4 and 5 are similar to the safes 10 of FIGS. 2 and 3; therefore, like structure will be identified by like reference numerals plus "100" and only the differences will be discussed hereafter. FIGS. 4 and 5 illustrate that the safe 110 is a doubled-walled structure discussed in greater detail below. Although only one of the plurality of walls is shown, it should be understood that the top, the bottom, the sides, and the door may include the double-walled structure discussed in greater detail below.

With respect to FIG. 4, the safe 110 includes an outer wall 150 coupled and substantially parallel to the inner wall 114', such that the wall 114' is closest to the interior space 120. In the illustrated embodiment, the outer wall 150 and inner wall 114' are welded together, but in other embodiments the outer wall 150 and inner wall 114' can be coupled in any suitable manner (i.e., integrally, by fasteners, or with adhesive). Because the outer wall 150 is spaced apart from the inner wall 114' by the bends 152 in inner wall 114', no spacers are necessary in this embodiment. The space between the outer wall 150 and the inner wall 114' is filled with a fire resistant or fire dampening material and an air gap. The outer wall 150 includes holes 154. The holes 154 may be permanently open or covered with a material such as low density polyethylene (LDPE) that is configured to be expelled when subject to a predetermined pressure from the interior space 120.

As discussed above with respect to FIGS. 2*a* and 2*b*, the pane 134 provides a barrier to dust and dirt intrusion and a barrier to moisture intrusion.). The pane 134 may be mechanically held in place by any form of attachment (e.g., by fasteners). In FIG. 4, the pane 134 seals against the wall 114'. The seal may be made via any suitable sealant or adhesive such as a high temperature silicone gel. The pane 134 is coupled to a surface of the wall 114' via fasteners 143 (i.e., by at least one screw/washer and nut assembly or the like). Additionally and importantly, the pane 134 automatically separates from the inner wall 114' at a predetermined temperature (i.e., a temperature lower than that at which ammunition detonates). The fasteners 143 are constructed of a material that has a melting point above the predetermined temperature, such as machine tool steel bolts, washers and nuts. In the embodiment of FIG. 4, the pane 134 is constructed from a material that has a lower melting point (i.e., the predetermined temperature) than the temperature at which ammunition detonates. The pane 134 material may be low density polyethylene (LDPE), for example, although any suitable material is within the scope of the invention. In the event of a fire, the panel 134 melts or otherwise separates from the inner wall 114' before the temperature within the safe 110 reaches that at which ammunition contained within will detonate so that opening 130 is exposed. The outer wall 150 is oriented relative and sufficiently close to the inner wall 114' and the opening 130 so that if the ammunition detonates, the outer wall 150 blocks and prevents debris and fragments from exiting the safe 110 through the opening 130. The fire-increased internal pressure of the safe 110 is released through the now-exposed opening 130, but the dangerous ammunition fragments are retained within the safe 110. Accordingly, similar to the safe 10 of FIGS. 2*a*-2*b*, internal pressure of the safe 110 can be released through the holes 130, 154 in the outer wall 150, but the dangerous fragments will be retained within the safe 110 by the outer wall 150.

In the embodiment shown in FIG. 5, the pane 134 in the inner wall 114' may be constructed of any suitable material (not necessarily material having a lower melting point than the temperature at which ammunition will detonate) and coupled to the inner wall 114' by fasteners 146 (e.g., screw, nuts, bolts and the like) as discussed above with respect to FIG. 3. In particular, the fasteners 146 may be constructed of a plastic material such as polyetheretherketone (PEEK), although fasteners 146 may be constructed of any suitable material with a melting temperature lower than the detonation temperature of the stored ammunition or other material. Accordingly, when the temperature within the safe 110 rises to the melting point of the fasteners 146, the fasteners 146 will melt and allow the pane 134 to fall away from the side of the safe, allowing internal high pressure heated air to escape through the opening 130, 154.

Various features and advantages of the invention are set forth in the following claims.

What is claimed is:

1. A safe for storing ammunition or other heat-sensitive explosive materials comprising:
- a plurality of walls;
- a door attached to one of the plurality of walls;
- an interior space defined by the plurality of walls and the door;
- an opening extending through one of the plurality of walls or the door;
- a pane coupled over the opening and to one of the plurality of walls or the door through which the opening extends, the pane automatically exposing the opening when the interior space reaches a predetermined temperature; and
- a cover coupled to the one of the plurality of walls or the door adjacent the pane so that the cover can block explosive materials from exiting the interior space upon detonation.

2. The safe of claim 1, wherein the predetermined temperature is lower than the temperature at which ammunition or other heat-sensitive explosive material detonates.

3. The safe of claim 2, wherein the pane is coupled to the one of the plurality of walls or the door by at least one fastener that is constructed from a material that has a melting point at the predetermined temperature.

4. The safe of claim 3, wherein the material is polyetheretherketone.

5. The safe of claim 1, wherein the cover is coupled to an exterior surface of the one of the plurality of walls or the door.

6. The safe of claim 1, wherein the cover is coupled to an interior surface of the one of the plurality of walls or the door.

7. The safe of claim 1, wherein the pane and the cover are spaced apart from each other by an air gap.

8. The safe of claim 1, wherein the pane and the cover are each larger than the opening.

9. A safe for storing ammunition or other heat-sensitive explosive materials comprising:
- a plurality of walls;
- a door attached to one of the plurality of walls;
- an interior space defined by the plurality of walls and the door;
- an opening extending through one of the plurality of walls or the door;
- a pane coupled over the opening, the pane automatically exposing the opening when the interior space reaches a predetermined temperature; and
- a cover coupled to the one of the plurality of walls or the door adjacent the pane,
- wherein the predetermined temperature is lower than the temperature at which ammunition or other heat-sensitive explosive material detonates,
- wherein the pane is formed of a material having a melting point that is lower than the predetermined temperature.

10. The safe of claim 9, wherein the material is low density polyethylene.

11. The safe of claim 9, wherein the cover is coupled to the one of the plurality of walls or the door by fasteners, the fasteners having a melting point that is higher than the predetermined temperature.

12. The safe of claim 11, wherein the cover is spaced apart from the one of the plurality of walls or the door by at least one spacer.

13. A safe configured to receive ammunition or other heat-sensitive explosive materials comprising:
- a plurality of walls forming the sides, bottom, and top of the safe;
- an outer wall coupled to and substantially parallel to one of the plurality of walls, the outer wall including at least one pressure-venting hole;
- a door attached to one of the plurality of walls;
- an interior space defined by the plurality of walls and the door;
- an opening extending through one of the plurality of walls or the door; and
- a pane coupled over the opening to the one of the plurality of walls or the door with a material that melts at a predetermined temperature, the pane automatically uncoupling from the one of the plurality of walls or the door at a predetermined temperature,
- wherein the opening and outer wall are positioned relative to each other so that upon detonation of the ammunition or other heat-sensitive explosive materials received within the safe, the outer wall blocks and prevents debris from exiting the safe through the opening.

14. The safe of claim 13, wherein the predetermined temperature is the temperature at which ammunition detonates.

15. The safe of claim 13, wherein the pane is coupled to the one of the plurality of walls or the door by at least one fastener that is constructed from a material that has a melting point that is lower than the predetermined temperature.

16. The safe of claim 15, wherein the material is polyetheretherketone.

17. The safe of claim 13, wherein the outer wall is spaced from the pane by an air gap.

18. The safe of claim 13 wherein the pane is spaced apart from the one of the plurality of walls or the door to which it is coupled.

19. A safe configured to receive ammunition or other heat-sensitive explosive materials comprising:
- a plurality of walls forming the sides, bottom, and top of the safe;

an outer wall coupled to and substantially parallel to one of the plurality of walls, the outer wall including at least one pressure-venting hole;

a door attached to one of the plurality of walls;

an interior space defined by the plurality of walls and the door;

an opening extending through the one of the plurality of walls or the door, and a pane coupled over the opening to one of the plurality of walls or the door with a material that melts at a predetermined temperature, the pane automatically uncoupling from the one of the plurality of walls or the door at a predetermined temperature, wherein the predetermined temperature is the temperature at which ammunition detonates, wherein the pane is formed of a material having a melting point that is lower than the predetermined temperature.

20. The safe of claim 19, wherein the material is low density polyethylene.

* * * * *